United States Patent [19]

Lindblad et al.

[11] Patent Number: 4,970,560

[45] Date of Patent: Nov. 13, 1990

[54] LUBRICATED METAL CLEANING BLADE FOR USE IN DRY ELECTROPHOTOGRAPHIC PROCESSES

[75] Inventors: Nero R. Lindblad, Ontario; Herbert C. Relyea, Webster, both of N.Y.

[73] Assignee: Xerox Corporation, Stamford, Conn.

[21] Appl. No.: 288,317

[22] Filed: Dec. 22, 1988

[51] Int. Cl.[5] ..... G03G 15/00

[52] U.S. Cl. ..... 355/299; 355/296

[58] Field of Search ..... 355/299, 296, 297; 15/256.5, 256.51, 256.52; 204/14.1, 32.1; 427/405, 409

[56] References Cited

U.S. PATENT DOCUMENTS

| | | | |
|---|---|---|---|
| 2,361,554 | 10/1944 | Lundbye | 29/148 |
| 2,404,689 | 7/1946 | Carlsen et al. | 101/153 |
| 3,848,993 | 11/1974 | Hasiotis | 355/15 |
| 4,264,191 | 4/1981 | Gerbasi etal. | 355/15 |
| 4,347,212 | 8/1982 | Carter | 264/315 |
| 4,348,163 | 9/1982 | Gilbert | 417/462 |
| 4,426,151 | 1/1984 | Aguro et al. | 355/15 |
| 4,492,554 | 1/1985 | Carter | 425/383 |
| 4,588,480 | 5/1986 | Thoma | 204/32.1 X |
| 4,615,171 | 10/1986 | Burk | 474/206 X |
| 4,621,026 | 11/1986 | Robinson | 427/374.1 X |
| 4,623,546 | 11/1986 | Holay et al. | 426/448 |
| 4,666,787 | 5/1987 | Bickle et al. | 427/409 X |
| 4,668,348 | 5/1987 | Jones et al. | 204/32.1 X |
| 4,701,354 | 10/1987 | Kitamura et al. | 427/405 X |
| 4,702,591 | 10/1987 | Tsuda et al. | 355/299 |
| 4,714,529 | 1/1987 | Wang et al. | 204/14.1 X |
| 4,751,948 | 6/1988 | Hertig et al. | 141/67 |
| 4,755,400 | 7/1988 | Dempsey et al. | 427/409 X |
| 4,811,590 | 3/1989 | Cheung | 72/482 |
| 4,819,026 | 4/1989 | Lange et al. | 355/15 |
| 4,823,161 | 4/1989 | Yamada et al. | 355/299 |
| 4,825,249 | 4/1989 | Oki et al. | 355/299 |
| 4,846,122 | 7/1989 | Kristof et al. | 123/179 |

FOREIGN PATENT DOCUMENTS 59-168483 9/1984 Japan .

OTHER PUBLICATIONS

Spencer et al.; "Impregnated Poromeric Material Cleaning Blade"; Xerox Disclosure Journal; vol. 1, No. 4; Apr. 1976; p. 79.

Thayer; "Low Friction Coating for Blade Cleaner Photoreceptor Supports"; Xerox Disclosure Journal; vol. 13, No. 2; Mar./Apr. 1988; p. 101.

*Primary Examiner*—A. C. Prescott

*Attorney, Agent, or Firm*—Mark Costello

[57] ABSTRACT

A coating process for the manufacture of cleaning blades is used where a hardened material coating is electro-deposited onto a carbon steel cleaning blade. The coating process is selected to provided a microporous surface. The pores thus produced are enlarged. The surface is sealed with sub-micron size particles of fluorocarbons, heat treated to create a smooth, slippery surface, while the hardened metal coating provides wear resistance to friction encountered during cleaning operation.

11 Claims, 1 Drawing Sheet

LUBRICATED METAL CLEANING BLADE FOR USE IN DRY ELECTROPHOTOGRAPHIC PROCESSES

This invention relates to reproduction apparatus and more particularly to cleaning apparatus including a lubricated metal cleaning blade.

BACKGROUND OF THE INVENTION

In electrophotographic applications such as xerography, a charge retentive surface is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface. The process is well known and useful for light lens copying from an original and printing applications from electronically generated or stored originals, where a charged surface may be imagewise discharged in a variety of ways. Ion projection devices where a charge is imagewise deposited on a charge retentive substrate operate similarly. Cleaning blades might also be used for the removal of toner from the surface of a detoning roll used to collect toner from the bristles of a brush cleaner, as shown for example in U.S. Pat. No. 4,819,026 to Longe et al, and assigned to the same assignee as the present application.

Although a preponderance of the toner forming the image is transferred to the paper during the transfer step, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum operation that the toner remaining on the surface be cleaned thoroughly therefrom. Blade cleaning is a highly desirable method for removal of residual toner and debris (hereinafter, collectively referred to as "toner") from a charge retentive surface, because it provides a simple, inexpensive structure compared to the various fiber or magnetic brush cleaners that are well known in the dry electrophotography art. In a typical application, a relatively thin elastomeric blade member is provided and supported adjacent and transversely across the charge retentive surface with a blade edge chiseling or wiping toner from the surface. Subsequent to release of toner from the surface, the released toner accumulating adjacent the blade is transported away from the blade area by a toner transport arrangement or gravity. Unfortunately, blade cleaning suffers from certain deficiencies, primarily resulting from the frictional sealing contact which must be maintained between the blade and the charge retentive surface. Friction between the surfaces causes wearing away of the blade edge, and damaging wearing contact with the charge retentive surface. To reduce friction, various blade lubricating materials or toner lubricant additives have been proposed. However, lubricants tend to change the operational characteristics of the electrophotographic system undesirably.

In addition to the problem of wear, which is more or less predictable over time, blades are also subject to unpredictable failures. In normal operational configuration, with a coefficient of dynamic friction in the range of about 0.5 to 1.0, a blade cleaning edge or tip in sealing contact with the photoreceptor is tucked slightly as shown in FIG. 1. The blade is not in intimate contact with the photoreceptor, but slides on toner particles and lubricant, to maintain the sealing contact required for cleaning. In this configuration however, the blade may flatten toner that passes under the blade and cause impaction of toner on the surface. The impact from carrier beads remaining on the charge retentive surface subsequent to development may damage the blade, and sudden localized increases in friction between the blade and surface may cause the phenomenon of tucking, where the blade cleaning edge becomes tucked underneath the blade, losing the frictional sealing relationship required for blade cleaning. These problems require removal and replacement of the blade. Filming on the charge retentive surface may occur even though toner is cleaned from the surface. Filming, which can be a gradual buildup of material on the charge retentive surface can deteriorate image quality. Filming occurs either uniformly or streaking, due to deficiencies in blade cleaning, requiring the use of a lubricant and a balancing abrasion element to prevent filming.

U.S. Pat. No. 3,848,993 to Hasiotis and U.S. Pat. No. 4,426,151 to Aguro et al. describe cleaning blades with elastomer tips integrally mounted on flexible metal supports. JP-A 59-168483 teaches a chiseling metal blade with a knife edge and having a lubricant layer applied an upper surface so that the leading edge of the blade is provided with lubricant contacting the photoreceptor. The cleaning blade wears to provide lubricant at the contact between blade and photoreceptor. U.S. Pat. No. 4,264,191 to Gerbasi et al. suggests other combinations of laminated material, wherein a hard substrate material is laminated with a photoreceptor-contacting soft material having a relatively low coefficient of friction with respect to the photoreceptor material. Xerox Disclosure Journal, Vol. 1, No. 4, Apr. 1976, pg. 79, "Impregnated Poromeric Material Cleaning Blade", by P. Spencer and D. Fisher, suggests that a poromeric structure, such as a composite of polyester fibers bound together in polyurethane, may be impregnated with a lubricant. U.S. Pat. No. 2,404,689 to Carlsen et al. teaches a cleaning blade in a liquid ink device with a beveled blade having a chromium layer in contact with the surface. U.S. Pat. No. 2,361,554 to Lundbye shows another chromium plated blade for use in cleaning a liquid ink device.

While it might appear that a rigid metal blade might solve the problems of rigidity and wear in dry toner electrophotographic applications, in fact, the frictional contact required between the surface and blade quickly wears away the blade and any surface lubricants applied thereto. As the blade edge wears, it changes from a chiseling edge to a rounded or flattened surface which requires a high force to maintain the edge in sealing contact. While a beveled edge is useful in liquid toner applications, it is highly susceptible to damage and wear in dry toner applications. Accordingly it is desirable to maintain the square edge without wear. Additionally, wearing friction may generate toner fusing temperatures, causing toner to fuse to the blade, or the photoreceptor.

Xerox Disclosure Journal, Vol. 13, No. 2, Mar./Apr. 1988, pg. 101, "Low Friction Coating for Blade Cleaner Photoreceptor Supports", by Bruce Thayer, suggest that a support structure for the cleaning blade and in contact with the opposite side of a photoreceptor might be provided with an aluminum extrusion anodized and impregnated with a polytetrafluoroethylene, nickel-phosphorus impregnated with polymers, or porous bronze sintered onto the surface of the support with an overlayer of polytetrafluoroethylene lead.

SUMMARY OF THE INVENTION

In accordance with the invention there is provided an improved metal cleaning blade for removal of dry toner and debris from a charge retentive or photoreceptor surface.

A metal cleaning blade is provided, with a porous hard, non-wearing coating preventing excessive wear of the blade due to friction, with a lubricant impregnated into the pores of the coating to produce a low friction exterior surface.

In accordance with one aspect of the invention, a coating process for the manufacture of cleaning blades is used where a hardened material coating is electrodeposited onto a carbon steel cleaning blade. The coating process is selected to provide a micro-porous surface. The pores thus produced are enlarged. The surface is sealed with sub-micron size particles of fluorocarbons, heat treated to create a smooth, slippery surface.

The process gives an improved hardness, protection against chemical attack, better abrasion resistance and permanent lubricity, (lubricity until the blade edge is undesirably worn), providing a marked increase in part life, and appears to improve the squareness of edges on the blades. Metal blades have the advantages of not tucking, insensitivity to toner mass and charge density or toner composition, and allow biasing to enhance cleaning. In general, cleaning blades are a low cost cleaner element, and provide the intimate contact with the photoreceptor necessary for the removal of undesirable films and debris. The lubricant-impregnated hard surface maintains a low friction contact with the charge retentive surface much longer than relatively soft lubricant overcoating.

These and other aspects of the invention will become apparent from the following description used to illustrate a preferred embodiment of the invention read in conjunction with the accompanying drawings in which.

Figure 1:
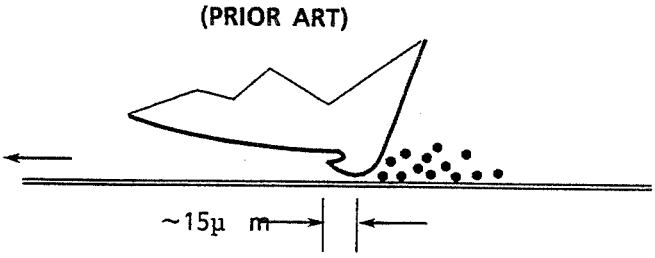
FIG. 1 shows the standard operational configuration of a known elastomeric cleaning blade in cleaning engagement with a charge retentive surface.
Figure 2:
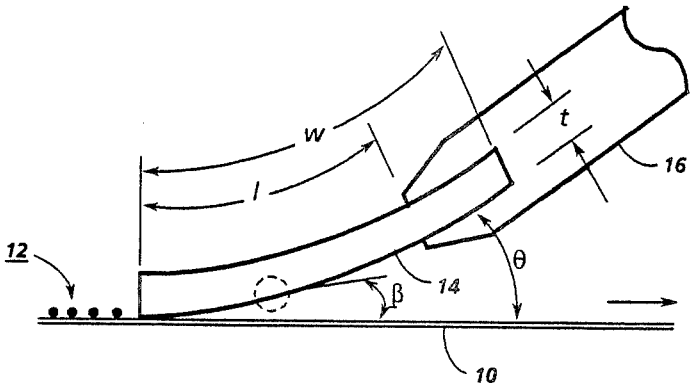
FIG. 2 shows the inventive cleaning blade in one possible cleaning configuration.

Referring now to the drawings, where the showings are for the purpose of describing a preferred embodiment of the invention and not for limiting same, FIG. 2 shows a desirable arrangement for supporting a metal cleaning blade in cleaning relationship with a moving imaging surface. An imaging member such as a photoconductive belt 10, which has toner and debris indicated generally as 12, is provided with a blade cleaning arrangement for the removal of toner from the belt. In a 12 o'clock cleaning arrangement, a blade 14 is supported above a portion of the belt for release and accumulation of toner adjacent thereto. A blade holder 16 is provided to support blade 14 in a sealing contact with belt 10. (By contrast, toner enters the nip between an elastomeric cleaning blade and the imaging member in FIG. 1.) The blade holder angle $\theta$ typically ranges from 10° to 30°. The blade desirably has flexibility to bend to provide a working angle $\beta$ in the range of 2° to 15°. Typically the free length I of blade 14 extending from blade holder 16 is about 0.4 inches, and the thickness t of blade 14 ranges from 0.0015 to 03015 inches. The described blade arrangement is only exemplary, and other blade arrangements are possible. In the 12 o'clock cleaning arrangement, a toner removal arrangement must be provided to remove released toner from the area adjacent to the blade. A blade cleaning arrangement may also be oriented in a 9 o'clock arrangement, where the blade is supported to allow gravity to release toner accumulated at the blade cleaning edge.

Figure 2A:
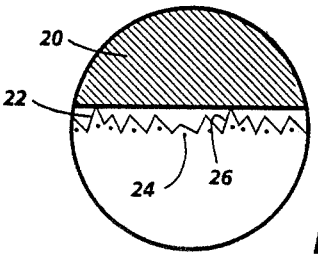
FIGS. 2A and 2B show a cross section of the inventive hard metal lubricated cleaning blade before and after heating.
Figure 2B:
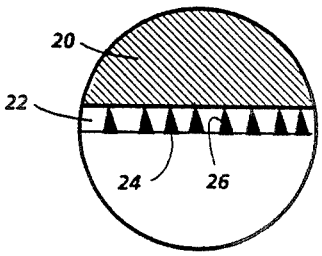

In accordance with the invention, as shown in FIG. 2A, a metal cleaning blade substrate 20 is provided, with a porous plating 22 and lubricant particles 24 in the pores 26 of the coating. After heating, as shown in FIG. 2B, the plating is hardened, producing a non-wearing surface that will prevent excessive wear of the blade due to friction. The pores in the plating are enlarged with heating, and the lubricant melts to fill the pores. The lubricant-filled pores at the blade surface produces a low friction exterior surface.

In one working embodiment, a carbon steel blade was plated with a hardened material coating electro-deposited onto a carbon steel blade at a thickness in the range of about 5 microns. Subsequently, a fluorocarbon lubricant was infused into pores in the plating. The process used was the POLY-OND process, a trade secret process of Poly Plating, Inc., Chicopee, MA for producing corrosion and wear resistant parts. In the POLY-OND process, a metal cleaning blade of the desired size and shape, optionally ground and/or lapped to provide square edges, is believed to be cleaned prior to plating. The POLY-OND process uses a nickel-phosphorus coating over a carbon steel substrate to provide a Rockwell hardness in the range of Rc 50. After heat treatment (baking at 700° F.), a hardness of 68–70 Rc can be achieved, with the baking temperature varied to vary the hardness. The resultant plated surface has a large number of micropores, the size of which were then somewhat increased by what is believed to be a heating process. Subsequently a fluorocarbon material, in this case TEFLON, (a trademark of the DuPont Corporation, Wilmington, DE for polytetrafluoroethylene) was infused into the enlarged pores. The resultant blade, when mounted as described, provided a coefficient of friction in the range of 0.3, when cleaning toner from a glass surface (cleaning a glass surface is similar to cleaning an AMAT surface) (a flexible photoreceptor belt material, as described for example in U.S. Pat. No. 4,265,990 to Stokal). i.e., the blade forces and friction are similar. Glass is used so that the blade and surface interface can be viewed. The surface of the blade provides lubricant areas and hard metal areas adjacent one another, providing both lubrication and resistance to wear. This process also has the characteristic of somewhat squaring the edges of the blade, if they had not been ground and/or lapped, although the ground and- /or lapped edges produced a better squared edge ultimately. Because the lubricant layer is infused into the pores of the hard metal coating, it is believed that as the lubricant layer wears from use, more lubricant will be exposed, and the blade will have extended life. Additionally, AMAT surfaces cleaned with a metal blade for an extended period of time, appear to have a finely polished appearance, indicating that some wear occurs over the time. The polishing-type wear noted is believed desirable because it removes fine scratches from the surface caused by abrasion thereof from carrier, toner and the like. It is expected that the plated metal blade with lubricant infused will produce similar results.

Another process believed to be suitable for the present application may be the NEDOX or MAGNAPLATE "HMF" processes, a trade secret process of the General Magnaplate Corporation, of Linden, NJ. The description of this process describes the coatings as synergistic, to be created during a multi-step process that combines the advantages of anodizing or hard-coat plating with the controlled infusion of low friction polymer and/or dry lubricants. The description of the NEDOX process reports that a coating of chrome-nickel alloy will be electrodeposited onto a metal surface. The deposit contains a large number of micropores that will then be enlarged in some unreported manner, but believed to be by heating. The surface will then be sealed with a controlled infusion of submicron size particles of a lubricant such as a fluorocarbon, after which it will be carefully heat treated to create a smooth slippery surface, giving improved surface hardness, protection against chemical attack, better abrasion resistance and permanent lubricity. The MAGNAPLATE "HMF" process suggests that it will provide lower friction generation surfaces.

The invention has been described with reference to a preferred embodiment. Obviously modifications will occur to others upon reading and understanding the specification taken together with the drawings. This embodiment is but one example, and various alternatives modifications, variations or improvements may be made by those skilled in the art from this teaching which are intended to be encompassed by the following claims.

We claim:

1. A cleaning blade for use in removal of dry toner from an imaging surface in an electrostatographic device, said cleaning blade comprising:

a metal substrate;

a hard metal coating, deposited on the metal substrate and providing large number of pores; and a lubricant layer, infused into the pores of the hard metal coating.

2. A cleaning blade as described in claim 1 wherein said metal substrate is a carbon steel.

3. A cleaning blade as described in claim 2 wherein said metal substrate is carbon steel, cut to desired shape and size.

4. A cleaning blade as described in claim 1 wherein the a hard metal coating is selected to provide a Rockwell hardness in the range of Rc 50–Rc70.

5. A cleaning blade as described in claim 1 wherein said hard metal coating is a phosphorus nickel.

6. A cleaning blade as described in claim 1 wherein said hard metal coating is a chrome nickel alloy.

7. A cleaning blade as described in claim 1 wherein said lubricant layer is a fluorocarbon.

8. A cleaning blade as described in claim 1, wherein said lubricant is polytetrafluoroethylene.

9. A method of making a hard metal lubricated cleaning blade for use in removing dry toner from an imaging surface in an electrostatographic device including the steps:

providing a metal substrate cut to desired shape and dimension;

electro-depositing a hard metal coating over said metal substrate, providing a generally micro porous surface; and infusing a layer of lubricant material into the porous surface of the hard metal coating.

10. The method as described in claim 9 and including the further step of grinding and lapping cut edges of the metal substrate for squareness.

11. The method as described in claim 9 and including the further step of cleaning the surface of the substrate prior to electrodeposition the hard metal coating.

* * * * *